US005352296A

United States Patent [19]

Wittel et al.

[11] Patent Number: 5,352,296

[45] Date of Patent: Oct. 4, 1994

[54] PROCESS FOR CLEANING METAL SURFACES

[75] Inventors: Klaus Wittel, Franfkurt am Main; Georg Blümlhuber, Oberasbach, both of Fed. Rep. of Germany

[73] Assignee: Metallgesellschaft Aktiengesellschaft, Frankfurt am Main, Fed. Rep. of Germany

[21] Appl. No.: 956,737

[22] Filed: Oct. 2, 1992

[30] Foreign Application Priority Data

Oct. 5, 1991 [DE] Fed. Rep. of Germany ..... 4133100

[51] Int. Cl.[5] ..... C23G 1/14

[52] U.S. Cl. ..... 134/2; 134/10; 252/540

[58] Field of Search ..... 134/2, 10; 252/540

[56] References Cited

U.S. PATENT DOCUMENTS 3,870,560 3/1975 Shumaker ..... 134/2
4,201,664 5/1980 Hekal ..... 134/10

OTHER PUBLICATIONS

Metal Surfaces Dec. 6, 1988.

*Primary Examiner*—José G. Dees
*Assistant Examiner*—Dwayne C. Jones
*Attorney, Agent, or Firm*—Herbert Dubno

[57] ABSTRACT

In a process of cleaning metal surfaces with aqueous alkaline cleaning solutions, which contain silicates and surfactants and are recycled after ultrafiltration, a solution is employed which contains silicate only as a sodium silicate and/or potassium silicate of the formula $Na_2O.2SiO_2.xH_2O$ and/or $K_2O.2SiO_2.xH_2O$. The cleaning solution is preferably adjusted to a pH value between 7 and 12 and to a concentration (expressed as $SiO_2$) of 0.1 to 20, particularly 0.5 to 10 g, silicate per liter.

8 Claims, 1 Drawing Sheet

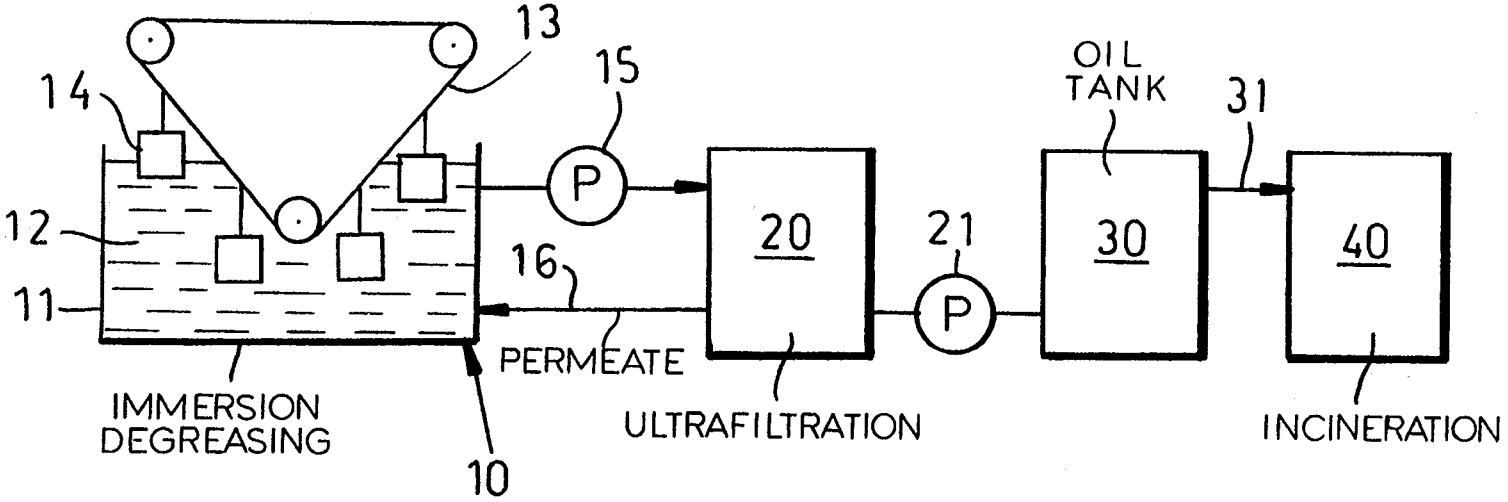
13
14
12
11
IMMERSION DEGREASING
10
15
P
16
PERMEATE
20
ULTRAFILTRATION
21
P
30
OIL TANK
31
40
INCINERATION

PROCESS FOR CLEANING METAL SURFACES

FIELD OF THE INVENTION

This invention relates to a process for cleaning metal surfaces with aqueous alkaline cleaning solutions, which contain silicates and surfactants and are recycled after ultrafiltration.

BACKGROUND OF THE INVENTION

It is known to degrease and clean metal surfaces by dipping them into or spraying them with alkaline reacting products, which are composed of one or more alkaline reacting components, such as borax, sodium metasilicate, tertiary sodium phosphate, sodium pyrophosphate, sodium polyphosphate, sodium carbonate and sodium hydroxide, and the corresponding potassium compounds. In their commercially available forms, they can have different water contents depending on the starting products.

The content of the principal components and/or builder substances will particularly depend on the nature of the contamination to be attacked, on the desired basicity and on the agressive action on the material to be cleaned.

Some of these cleaning agents have also small contents of organic surface active agents, such as ionic or nonionic surfactants and soaps (German Patent Publication 10 74 357). Known alkaline cleaning solutions can consist of an aqueous solution of mixtures of sodium metasilicate, sodium carbonate, sodium hydroxide and dodecyl benzene sulfonate or of sodium pyrophosphate, sodium polyphosphate, sodium tetraborate, sodium carbonate, and dodecyl benzene sulfonate (EP-A-O 372 601; Published German Application 38 43 148).

From "Chem.-Ing. Tech." 51 (1979), pages 662–664, it is also known in the metal-working industry to use ultrafiltration to regenerate cleaning emulsions. Aqueous cleaning solutions having pH values in the range of 4 to 13 and temperatures up to about 95° C. are used to remove oil, grease, dirt and metal fines. The laden cleaning emulsions must be renewed from time to time. This involves a loss of valuable substances and the creation of a considerable burden in the resulting waste water. The regeneration of cleaning emulsions by ultrafiltration results in a considerable prolongation of the useful life of the cleaning solutions and in a considerable decrease of the amount of sewage.

The regeneration of the cleaning baths by ultrafiltration technology is usually effected in that the high-oil retentate obtained by the ultrafiltration proper is fed to a recycling tank whereas the oil-free permeate is recycled to the cleaning bath. The recycling tank is fed from the cleaning bath. Ultrafiltration is effected to an oil concentration of 10 to 40% in the retentate, which is subsequently disposed of, e.g., by incineration, optionally after a further concentrating treatment. Because most of the inorganic contents remain in the permeate and an oil increase by a factor of about 100 is achieved, that recycling prolongs the useful life of the cleaning solution correspondingly and relieves the sewage.

In the ultrafiltration the filtration rate will substantially depend on the difference between the pressures in front of and behind the membrane and on the temperature of the liquid to be filtered and particularly depends on the enrichment of the retained components in front of the membrane.

If the widely used silicate-containing alkaline cleaning agents are used, the membrane will often be clogged. Such clogging will result in a rapid decrease of the flow rate expressed as the permeate volume per unit of time in the ultrafiltration. The reasons for that phenomenon have not definitely been clarified and this disadvantage has previously been tolerated.

OBJECTS OF THE INVENTION

It is an object of the invention to provide an improved process for the cleaning of metal surfaces with aqueous alkaline silicate-containing cleaning solutions and with simultaneous use of ultrafiltration technology.

Another object is to provide a process which is free of the disadvantages of known processes and has a distinctly higher tolerance to impurities formed in the process and, in particular, can be carried out for a longer time and more economically.

SUMMARY OF THE INVENTION

That object is accomplished in that the process of cleaning metal surfaces with aqueous, silicate- and surfactant-containing cleaning solutions, in which process the cleaning solution is recycled after ultrafiltration, is carried out in accordance with the invention in such a manner that the metal surfaces are cleaned with a solution which contains silicate only as sodium silicate and/or potassium silicate of the formula $Na_2O.2SiO_2.xH_2O$ or $K_2O.2SiO_2.xH_2O$, where x may vary widely and can be zero.

It has surprisingly been found that the ultrafiltration membrane will be clogged only after a prolonged use and that permeate will flow for a much longer time until the flow rates become intolerably low.

Thus the fact that the exclusive silicate in said solution is a sodium silicate and/or potassium silicate of the formula $Na_2O.2SiO_2.xH_2O$ and/or $K_2O.2SiO_2.xH_2O$ permits extended permeation through said membrane prior to blockage.

The sodium silicate and potassium silicate used in the process in accordance with the invention may also be defined by the formula $(Na_2Si_2O_5)_x.yH_2O$ or $(K_2Si_2O_5)_x.yH_2O$ and are commercially available as so-called disilicates. In these formulas x and y can vary widely. For example x may be 1 and y may can be zero or both may be other numbers. Owing to their chemical constitution these compounds are special silicates of a leaf-like or layer-like structure. Regarding their microstructure and their properties they differ substantially from the silicates which contain the anion $(Si_2O_7)^{6-}$ as a moiety and which are not used in the cleaning solutions for the process in accordance with the invention. The silicate is preferably used in the form of a sodium salt. The sodium salt is known and commercially available as a hydrous amorphous product or as an anhydrous crystalline product and can be employed in both forms in the cleaning solution used in the process in accordance with the invention. Such alkali silicates, such as the commercially available sodium disilicate, have a $SiO_2$ to $Na_2O$ molar ratio of 2.06 to 2.14. Amorphous hydrous products have approximately the composition 27.5% $Na_2O$, 57.0% $SiO_2$, 15.5% $H_2O$.

Commercially available substances are, e.g., the amorphous hydrous product "CupanonDI" of van Baerle in Gemshelm, Germany, or the crystalline "Schichtsilikat SKS-6" of Hoechst AG, Frankfurt, Germany.

According to a preferred feature of the invention the process is carried out with a cleaning solution having a pH value <12.0 so that the cleaning solution does not contain free sodium hydroxide or potassium hydroxide.

According to a further feature of the process in accordance with the invention the concentration of alkali silicate (expressed as $SiO_2$) in the cleaning solution employed is 0.1 to 20 g/l and more preferably 0.5 to 10 g/l.

In order to avoid disadvantages in the preparation of the cleaning solution and in the addition of water to compensate losses caused by evaporation and entraining, it is desirable to use softened water and particularly deionized water.

The cleaning solution is preferably used in a dipping process although other application technologies, such as spraying, flooding and the like, may also be used.

The cleaning solution is normally used at elevated temperatures in excess of 50° C. and up to its boiling point. Temperatures from about 55° to about 70° C. are suitably employed.

BRIEF DESCRIPTION OF THE DRAWING

The above and other objects, features and advantages of my invention will become more readily apparent from the following description, reference being made to the accompanying highly diagrammatic drawing in which the sole FIGURE of which is a diagram illustrating the principals of the invention.

SPECIFIC DESCRIPTION

The sole FIGURE of the drawing shows in principle a system for the degreasing or cleaning of metal surfaces in the form of objects 14 which are immersed by a conveyor system 13 supporting these objects via hangers, in the cleaning bath 12 of a tank 11 in the degreasing or cleaning stage 10.

The objects to be treated can then be rinsed, dried and, if desired, coated in accordance with conventional steps. The degreasing solution is a solution which contains as the only silicates the specific disilicates previously mentioned and in accordance with the specific examples illustrating this invention below.

The cleaning and degreasing solution is continuously regenerated at least in part by an ultrafiltration process represented by the ultrafiltration stage 20 equipped with membranes and the like. The depleted cleaning solution is withdrawn by a pump 15 and forces past the membranes. The permeate is returned at 16 to the cleaning tank 11. The retentate from ultrafiltration is introduced via pump 21 into an oil tank 30. The excess from the oil tank is delivered at 31 to an incineration stage 40.

SPECIFIC EXAMPLES

In the examples, various cleaning solutions were employed to clean oil-soiled deep-drawn parts of sheet steel (RSt 1405). The flow rate of permeate was compared with that of water at 60° C. The membrane was regarded as being clogged when the flow rate had decreased to 20% of the value for water. The experiments were carried out with a laboratory system of Eisenmann, Holzgerlingen, Germany, and with an inorganic membrane of the type Carbosep ® having a separating size of 160.00 daltons measured with dextran. The surfactant used in all examples consisted of a mixture of equal parts of dodecyl benzene sulfonate (Lutensit ® ALBN of BASF AG) and nonyl phenol polyethylene glycol ether (Arkopal ® N 100 of Hoechst AG).

EXAMPLE 1 (CONTROL EXAMPLE)

To prepare the cleaning solution, 20 g sodium metasilicate ($Na_2SiO_3.5H_2O$) per liter of solution, corresponding to about 10 g/l $SiO_2$, were dissolved in water having a hardness corresponding to 100 mg CaO per liter, and 2 g/l surfactant were added. The pH value of the solution was about 13. The solution was recycled after ultrafiltration. After about 2 hours the flow rate of permeate had decreased to 20% of the initial value for water.

EXAMPLE 2 (IN ACCORDANCE WITH THE INVENTION)

Anhydrous crystalline sodium disilicate $Na_2Si_2O_5$ (Schichtsilikat SKS-6 of Hoechst AG) was dissolved in deionized water to prepare a solution of 20 g disilicate per liter of solution, corresponding to about 13 g/l $SiO_2$, and 2 g/l surfactant were added. The pH value of the solution was about 11.5. The solution was recycled after ultrafiltration. After a filtration for 46 hours the flow rate of permeate had decreased only to about 40% of the initial value.

EXAMPLE 3 (CONTROL EXAMPLE)

A solid cleaning agent concentrate composed of 20% $Na_2SiO_3.5H_2O$, 25% $Na_4P_2O_7$, 25% $Na_5P_3O_{10}$, 15% $NaHCO_3$, 10% $Na_2CO_3$,5% surfactant was dissolved in deionized water to prepare a solution containing 30 g concentrate per liter of solution. The pH value of the solution was 11.6. The solution was recycled after ultrafiltration. After 1.5 hours the permeate flow rate had decreased to 20% of the initial value.

EXAMPLE 4 (IN ACCORDANCE WITH THE INVENTION)

A solid cleaning agent concentrate composed of 17.3% $Na_2Si_2O_5$ (Cupanon DI of van Bearle), 7.0% NaOH, 15.0% $NaHCO_3$, 10.0% $Na_2CO_3$, 23.0% $Na_4P_2)_7$, 22.7% $Na_5P_3O_{10}$, 5.0% surfactant, was dissolved in softened water to prepare a solution containing 30 g concentrate per liter of solution. The pH value of the solution was 11.6. The solution was recycled after ultrafiltration. After about 16.7 h the flow rate of permeate had decreased to 50% of the initial value.

From the Examples of the process in accordance with the invention, it is apparent that in the cleaning metallic solutions with a cleaning solution which is ultrafiltered the useful life of the cleaning will considerably be increased if a cleaning solution is employed which contains silicate only as disilicate of the formula $Na_2O.2SiO_2.xH_2O$ and/or $K_2O.2SiO_2.xH_2O$.

We claim:

1. A process for cleaning a metal surface comprising the steps of:

(a) preparing a cleaning solution which contains a silicate cleaning agentand surfactants, and wherein the silicate of said cleaning agent is exclusively a silicate selected from the group of sodium silicate and potassium silicate of the formula $Na_2O.2SiO_2.xH_2O$ and/or $K_2O.2SiO_2.xH_2O$ and mixtures thereof;

(b) treating a metal surface with said solution at a temperature and for a time sufficient to clean said metal surfaces; and (c) regenerating said solution by subjecting said solution to ultrafiltration through an ultrafiltration membrane and recycling a permeate of said solution after ultrafiltration to step (b) whereby the fact that the exclusive silicate in said solution is a sodium silicate and/or potassium silicate of the formula $Na_2O.2SiO_2.xH_2O$ and/or $K_2O.2SiO_2.xH_2O$ permits extended permeation through said membrane prior to blockage.

2. The process defined in claim 1, further comprising the step of adjusting the pH of said solution to a value between 7 and 12.

3. The process defined in claim 1, wherein the concentration of said exclusive silicate is substantially 0.1 to 20 g per liter expressed as $SiO_2$.

4. The process defined in claim 3, wherein said concentration is 0.5 to 10 g of $SiO_2$ per liter.

5. The process defined in claim 1, further comprising the step of preparing said solution with softened and deionized water.

6. The process defined in claim 5, further comprising the step of adjusting the pH of said solution to a value between 7 and 12.

7. The process defined in claim 6, wherein the concentration of said exclusive silicate is substantially 0.1 to 20 g per liter expressed as $SiO_2$.

8. The process defined in claim 7, wherein said concentration is 0.5 to 10 g of $SiO_2$ per liter.

* * * * *